US007990030B2

(12) United States Patent
Ku et al.

(10) Patent No.: US 7,990,030 B2
(45) Date of Patent: Aug. 2, 2011

(54) LAMP ASSEMBLY

(75) Inventors: Chin-Long Ku, Taipei Hsien (TW); Chin-Wen Yeh, Taipei Hsien (TW); Zhen-Neng Lin, Shenzhen (CN); Zhi-Jian Peng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 44 days.

(21) Appl. No.: 12/626,686

(22) Filed: Nov. 27, 2009

(65) Prior Publication Data

US 2011/0084585 A1 Apr. 14, 2011

(30) Foreign Application Priority Data

Oct. 12, 2009 (CN) ..... 2009 1 0308211

(51) Int. Cl.
*H01J 61/52* (2006.01)
*F21V 29/00* (2006.01)

(52) U.S. Cl. ..... 313/12; 313/35; 313/46; 362/126; 362/294

(58) Field of Classification Search ..... None
See application file for complete search history.

(56) References Cited

U.S. PATENT DOCUMENTS 7,309,146 B2 * 12/2007 Hayashi et al. ..... 362/294
2010/0264826 A1 * 10/2010 Yatsuda et al. ..... 315/112
* cited by examiner

*Primary Examiner* — Ashok Patel
(74) *Attorney, Agent, or Firm* — Zhigang Ma

(57) ABSTRACT

A lamp assembly includes a storage tank, a lamp, a liquid inlet pipe, a liquid outlet pipe and an actuator. The storage tank contains liquid therein. The lamp includes a lighting portion and a lid located at a top of the lighting portion. A flume is defined between a top end of the lighting portion and the lid. The liquid inlet pipe connects a first end of the storage tank and a corresponding end of the flume. The liquid outlet pipe connects an opposite second end of the storage tank and a corresponding end of the flume of the lamp. The actuator drives the liquid to circulate between the storage tank and the flume of the lamp to thereby dissipate heat generated by the lamp.

15 Claims, 3 Drawing Sheets

LAMP ASSEMBLY

BACKGROUND

1. Technical Field

The present disclosure relates to lamp assemblies and, more particularly, to a lamp assembly utilizing liquid to dissipate heat generated thereof.

2. Description of Related Art

Generally, a lamp comprises a light source, a sheet enclosing the light source and a heat sink mounted on the sheet to dissipate heat generated by the light source. When the light source is high-power and generates a plurality of heat, the heat accumulates on the sheet. Thus, the light source is prone to overheat to adversely affect the stability of the lamp.

What is needed, therefore, is a lamp assembly which can overcome the limitations described.

DETAILED DESCRIPTION

Figure 1:
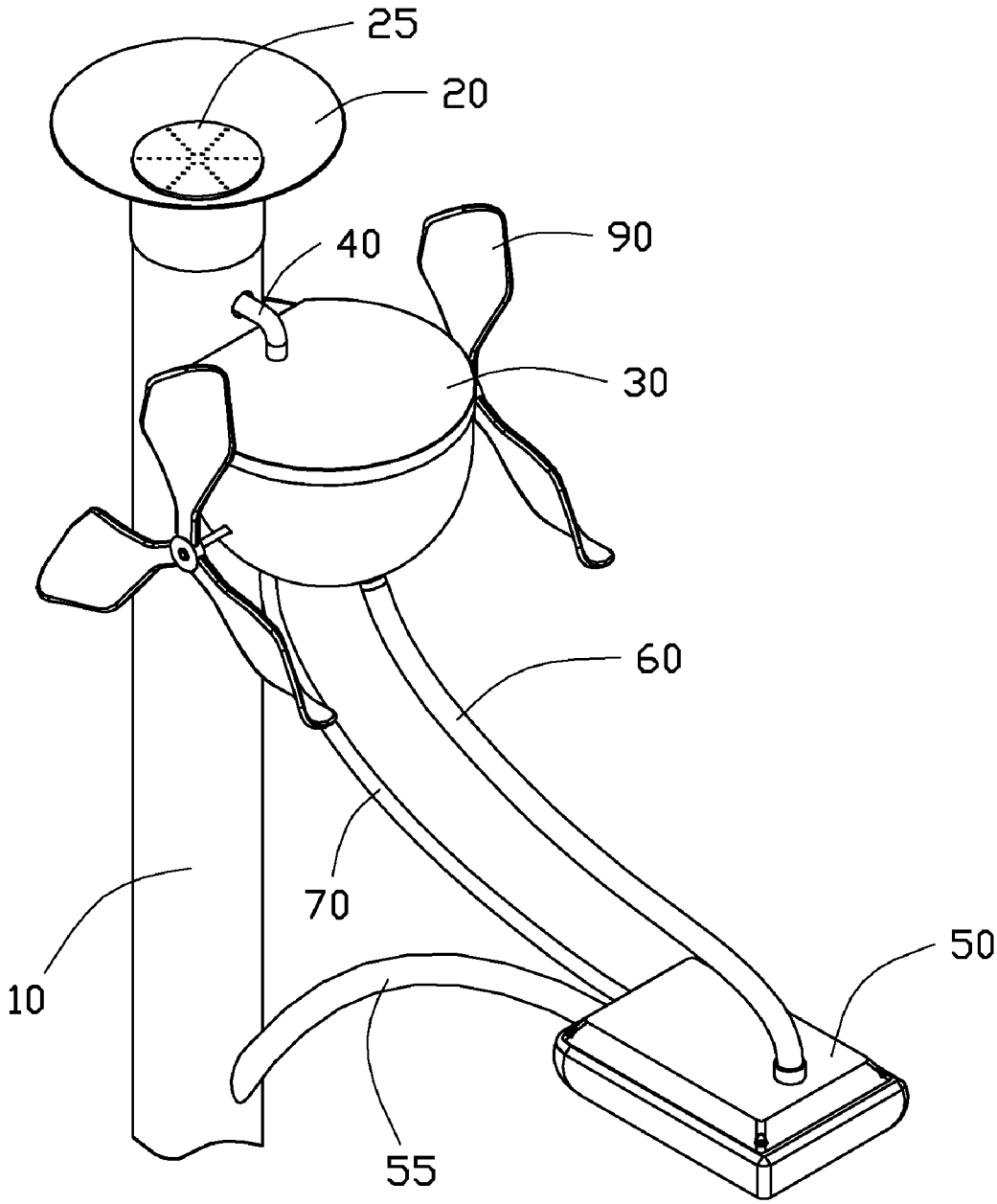
FIG. 1 is an isometric, assembled view of a lamp assembly in accordance with an embodiment of the present disclosure.

Referring to FIG. 1, a lamp assembly in accordance with an embodiment of the present disclosure comprises a hollow, cylindrical lamppost 10, a gathering tank 20, a storage tank 30, a lamp 50, a liquid inlet pipe 70 and a liquid outlet pipe 60. The gathering tank 20 is mounted on a top end of the lamppost 10. The storage tank 30 is mounted on a side of the lamppost 10 and below the gathering tank 20. A tube 40 connects the gathering tank 20 with the storage tank 30. The lamp 50 is mounted on a side of the lamppost 10 and below the storage tank 30. The liquid inlet pipe 70 and the liquid outlet pipe 60 connect the storage tank 30 with the lamp 50 to form a liquid circulation loop.

Figure 2:
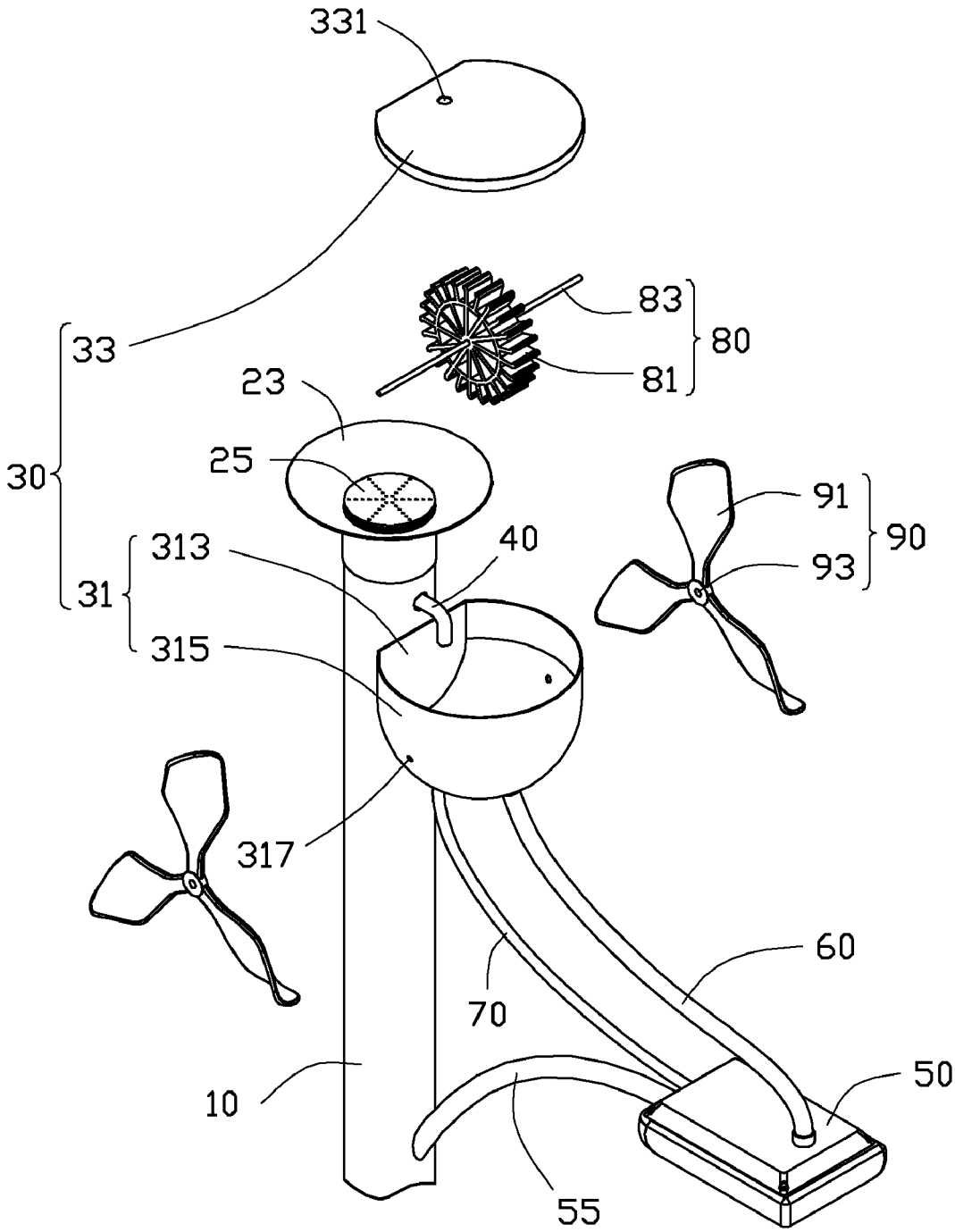
FIG. 2 is an exploded view of the lamp assembly of FIG. 1.
Figure 3:
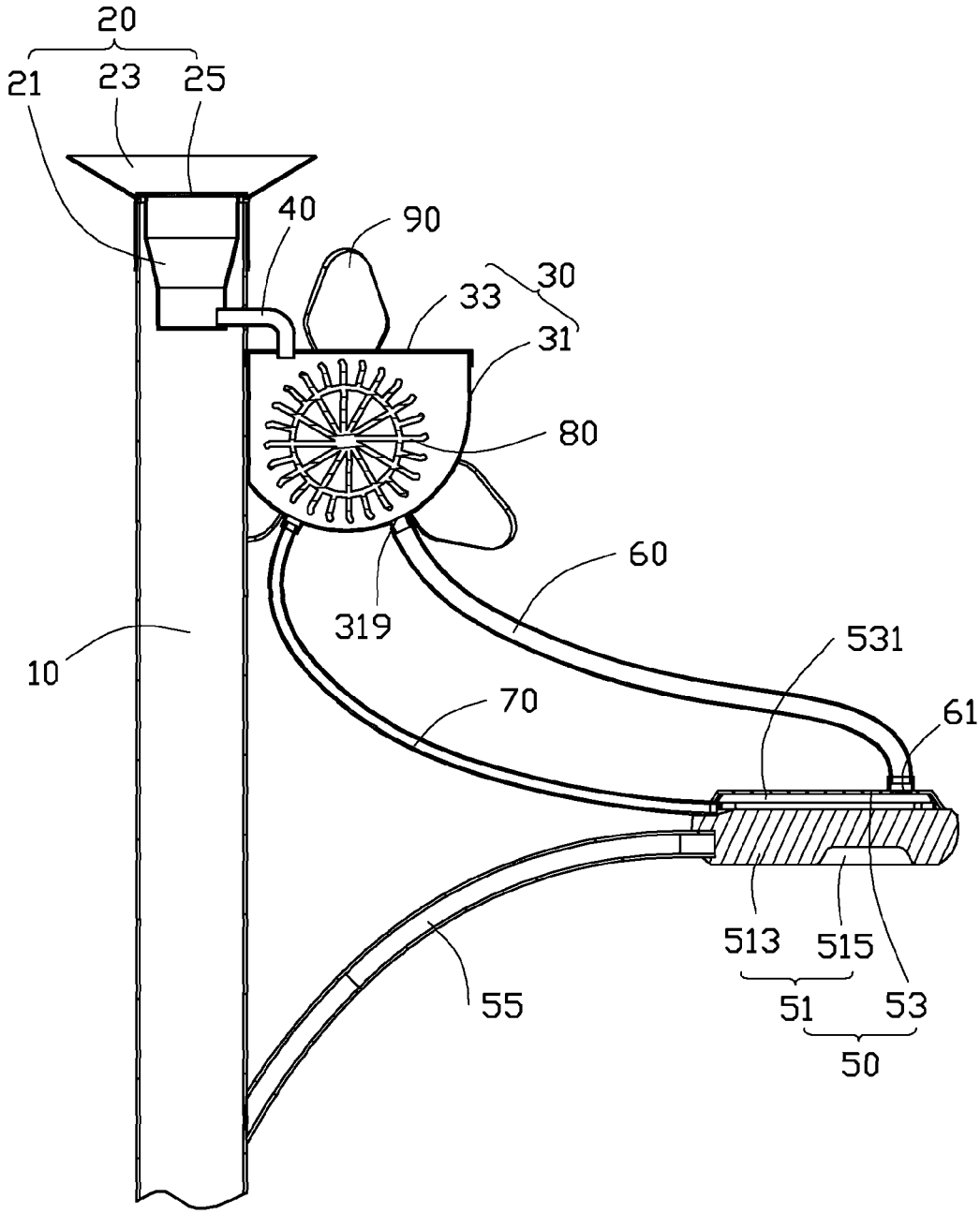
FIG. 3 is a cross-sectional view of the lamp assembly of FIG. 1.

Referring to FIGS. 2-3 also, the gathering tank 20 comprises a storage portion 21, a guiding portion 23 and a filter 25. The guiding portion 23 has a bugle-shaped configuration and a top end thereof is larger than a bottom end thereof. A periphery of the bottom end of the guiding portion 23 abuts against the top end of the lamppost 10. The guiding portion 23 collects liquid such as rainwater or liquid offered by man fallen thereon and guide such liquid to the storage portion 21. The storage portion 21 is a hollow cylinder and enclosed by the lamppost 10. The storage portion 21 extends downwardly from the bottom end of the guiding portion 23. The filter 25 is a circular sheet and mounted at a joint of the guiding portion 23 and the storage portion 21 to remove impurities in the liquid before the liquid enters the storage portion 21. The storage portion 21 accommodates therein the liquid flowing through the filter 25.

The tube 40 has an L-shaped configuration and opposite ends thereof extend through a bottom end of the storage portion 21 of the gathering tank 20 and a top end of the storage tank 30 to guide the liquid in the storage portion 21 into the storage tank 30. The tube 40 comprises a liquid inlet (not labeled) received in the storage portion 21 and a liquid outlet (not labeled) received in the storage tank 30.

The storage tank 30 is made of metallic sheet and used to stock liquid flowing from the gathering tank 20. A configuration and volume of the storage tank 30 are various according to different requirements. In this embodiment, the storage tank 30 is a hemispheroid having a planar top surface. The storage tank 30 comprises a hemispherical barrel 31 and a planar cover 33 covering the barrel 31. The cover 33 defines a through hole 331 near an edge thereof to receive an end of the tube 40 which has the liquid outlet. The barrel 31 comprises a vertical, planar connecting plate 313 and an arc-shaped extending plate 315 connecting with the connecting plate 313. The connecting plate 313 has a straight top edge (not labeled), two straight side edges (not labeled) perpendicular to the top edge, and an arc-shaped bottom edge (not labeled) interconnecting bottom ends of the two side edges. The extending plate 315 connects with the side edges and bottom edges of the connecting plate 313 to form the barrel 31. The connecting plate 313 is welded on the lamppost 10 to mount the storage tank 30 on the lamppost 10. Two mounting holes 317 are defined at opposite sides of the extending plate 315. Two through holes 319 are defined at a bottom end of the extending plate 315 to receive ends of the liquid outlet pipe 60 and the liquid inlet pipe 70, respectively.

An actuator is received in the storage tank 30 to actuate the liquid received in the storage tank 30 so that the liquid can circulate between the storage tank 30, the liquid outlet pipe 60, the lamp 50 and the liquid inlet pipe 70. In this embodiment, the actuator is an impeller 80. The impeller 80 comprises an annular blade assembly 81 and a shaft 83 extending through a central portion of the blade assembly 81. Opposite ends of the shaft 83 extend through the mounting holes 317 of the extending plate 31 of the storage tank 30 and engage with two fans 90, respectively. As best seen in FIG. 3 a lateral side of the blade assembly 81 is just below the liquid outlet of the tube 40. Thus, the blade assembly 81 is driven to rotate by the liquid from the gathering tank 20. Each fan 90 comprises three arc-shaped blades 91 and a connecting portion 93 connected inner ends of the blades 91. The connecting portion 93 connects with a corresponding end of the shaft 83 of the impeller 80. When the fans 90 are driven by wind to rotate, the fans 90 drive the shaft 83 and the blade assembly 81 to rotate correspondingly.

The lamp 50 comprises a lighting portion 51 and a lid 53 located at a top of the lighting portion 51. The lighting portion 51 comprises a rectangular supporting portion 513 and a light source 515 received in the supporting portion 513. The light source 515 is light source which generates a great amount of heat, such as a halogen lamp, a high pressure sodium lamp or a LED lamp. In the preferred embodiment, the light source 515 is an LED lamp. Opposite ends of an arc-shaped pole 55 are mounted on the lamppost 10 and a lateral end of the supporting portion 513. Thus, the lamp 50 is securely mounted on the lamppost 10. The lid 53 has an inverted bowl-shaped configuration and a bottom end thereof encloses a periphery of a top end of the lighting portion 51. Thus, an elongated flume 531 is defined between the top end of the lighting portion 51 and a top surface of the lid 53 to receive the liquid therein.

The liquid inlet pipe 70 and the liquid outlet pipe 60 are metallic pipes. First ends of the liquid inlet pipe 70 and the liquid outlet pipe 60 are received in the through holes 319 of the extending plate 31 of the storage tank 30. Second ends of the liquid inlet pipe 70 and the liquid outlet pipe 60 extend through the lid 53 of the lamp 50 and are located at lateral ends of the lamp 50. The second end of the liquid outlet pipe 60 is located at a top portion of one lateral end of the lid 53 and faces to the top end of the lighting portion 51. The second end of the liquid inlet pipe 70 is located at a side portion of another lateral end of the lid 53. Thus, the liquid flowing from the liquid outlet 60 impacts the top end of the supporting portion 513 of the lighting portion 51 directly and fills the flume 531 to absorb heat of the lighting portion 51. The heated liquid flows through the liquid inlet pipe 70 back to the storage tank 30. A filtrating sheet 61 is mounted on a bottom portion of the second end of the liquid outlet pipe 60 to filtrate the liquid before it flows out of the liquid outlet pipe 60 into the flume 531.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A lamp assembly comprising:

a storage tank containing an amount of liquid therein;

a lamp comprising a lighting portion and a lid located at a top of the lighting portion, a flume defined between a top end of the lighting portion and the lid;

a liquid inlet pipe connecting a first end of the storage tank and a first end of the flume;

a liquid outlet pipe connecting a second end of the storage tank and a second end of the flume of the lamp; and an actuator driving the liquid to circulate between the storage tank and the flume of the lamp to thereby dissipate heat generated by the lamp.

2. The lamp assembly as claimed in claim 1, wherein the actuator is an impeller and received in the storage tank and comprises a blade assembly and a shaft extending through the blade assembly and mounted on the storage tank.

3. The lamp assembly as claimed in claim 2, wherein an end of the shaft of the impeller extends through the storage tank and engages with a fan located at an outside of the storage tank.

4. The lamp assembly as claimed in claim 3, wherein the fan comprises a plurality of blades and a connecting portion connecting with the blades and the end of the shaft.

5. The lamp assembly as claimed in claim 2 further comprising a lamppost and a gathering tank mounted on the lamppost, and the liquid of the storage tank flows from the gathering tank into the storage tank.

6. The lamp assembly as claimed in claim 5, wherein the gathering tank is located at a top of the storage tank and opposite ends of a tube extend through the gathering tank and the storage tank to guide the liquid from the gathering tank into the storage tank.

7. The lamp assembly as claimed in claim 6, wherein an end of the tube received in the storage tank is located just above a side of the impeller, and the liquid flows through the tube and impacts the blade assembly of the impeller.

8. The lamp assembly as claimed in claim 6, wherein the gathering tank comprises a storage portion enclosed by the lamppost, a guiding portion extending upwardly from the storage portion and a filter mounted on a bottom end of the guiding portion, and the tube extends through a bottom end of the storage portion.

9. The lamp assembly as claimed in claim 1, wherein the lid has an inverted bowl-shaped configuration and a bottom end thereof encloses a periphery of a top end of the lighting portion, the flume is defined between the top end of the lighting portion and a top plate of the lid.

10. The lamp assembly as claimed in claim 9, wherein an end of the liquid outlet pipe is located at a top portion of one end of the lid and faces to the top end of the lighting portion of the lamp.

11. The lamp assembly as claimed in claim 1, wherein opposite ends of a pole connect the lamppost and an end of the lighting portion to mount the lamp on the lamppost.

12. A lamp assembly comprising:

a storage tank containing an amount of liquid therein;

a lamp comprising a supporting portion, a light source mounted on a bottom surface of the supporting portion, and a lid connected to a top surface of the supporting portion, the supporting portion and the lid cooperatively defining a chamber therebetween;

a first pipe connecting a first end of the storage tank to a first end of the chamber of the lamp;

a second pipe connecting a second end of the storage tank to a second end of the chamber of the lamp; and an impeller received in the storage tank and comprising a blade assembly and a shaft extending through the blade assembly and engaging with sidewalls of the storage tank;

a fan located at an outside of the storage tank and engaging with one end of the shaft of the impeller;

wherein the fan drives the impeller to rotate to make the liquid circulate between the storage tank and the chamber of the lamp.

13. The lamp assembly as claimed in claim 12 further comprising a lamppost and a gathering tank mounted on the lamppost, and the liquid of the storage tank flows from the gathering tank into the storage tank.

14. The lamp assembly as claimed in claim 13, wherein the gathering tank is located at a top of the storage tank and opposite ends of a tube extend through the gathering tank and the storage tank to guide the liquid of the gathering tank to the storage tank.

15. The lamp assembly as claimed in claim 14, wherein an end of the tube received in the storage tank is located above the impeller, and the liquid flows through the tube and impacts the blade assembly of the impeller.

* * * * *